US005450171A

United States Patent [19]

Demura et al.

[11] Patent Number: 5,450,171

[45] Date of Patent: Sep. 12, 1995

[54] BRUSH CHARGER AND IMAGE FORMING APPARATUS

[75] Inventors: Motohiro Demura; Makoto Matsuoka, both of Kawasaki, Japan

[73] Assignee: Fujitsu Limited, Kawasaki, Japan

[21] Appl. No.: 103,786

[22] Filed: Aug. 10, 1993

[30] Foreign Application Priority Data

Sep. 28, 1992 [JP] Japan ..... 4-257916

[51] Int. Cl.[6] ..... G03G 15/02

[52] U.S. Cl. ..... 355/219; 361/225

[58] Field of Search ..... 355/219, 222, 210; 361/225

[56] References Cited

U.S. PATENT DOCUMENTS

| | | | |
|---|---|---|---|
| 4,336,565 | 6/1982 | Murray et al. | 355/219 X |
| 4,455,078 | 6/1984 | Mukai et al. | 355/219 |
| 4,706,320 | 11/1987 | Swift | 355/219 X |
| 4,761,709 | 8/1988 | Ewing et al. | 355/219 X |
| 5,196,892 | 3/1993 | Mitsuaki | 355/219 X |
| 5,245,386 | 9/1993 | Asano et al. | 355/219 |
| 5,287,146 | 2/1994 | Uno et al. | 355/219 |

FOREIGN PATENT DOCUMENTS 5-100544 4/1993 Japan .

*Primary Examiner*—A. T. Grimley

*Assistant Examiner*—Sandra L. Brasé

*Attorney, Agent, or Firm*—Staas & Halsey

[57] ABSTRACT

Disclosed are a brush charger for preventing a rotary conductive brush, which contacts a latent image carrier to charge it, from bending along the rotary shaft of the conductive brush, and an image forming apparatus using this brush charger. The brush charger comprises a conductive rotary shaft; a conductive brush provided around the conductive rotary shaft in such a way that the tip of the conductive brush contacts the latent image carrier; a voltage source for applying a charging voltage to the conductive rotary shaft; elastic insulating members provided at both ends of the conductive rotary shaft, for restricting end portions of the conductive brush from spreading along the conductive rotary shaft; and stationary members respectively provided at one ends of the elastic insulating members, for compressing the elastic insulating members toward the conductive brush. The image forming apparatus comprises an endless latent image carrier; a brush charger for charging the endless latent image carrier, which includes the same components as the above-described brush charger; a image forming unit for forming an electrostatic latent image on the charged endless latent image carrier; and developing unit for developing the electrostatic latent image on the endless latent image carrier.

28 Claims, 10 Drawing Sheets

BRUSH CHARGER AND IMAGE FORMING APPARATUS

BACKGROUND OF THE INVENTION

Field of the Invention

The present invention relates to a brush charger for charging a latent image carrier such as a photosensitive drum and, and an image forming apparatus using this brush charger. More particularly, this invention relates to a brush charger which causes a conductive brush to contact a latent image carrier to charge it, and an image forming apparatus using this brush charger.

Description of the Related Art

Image forming apparatuses, such as a copying machine, a printer and a facsimile, employ a latent image forming type recording apparatus like an electrophotographing apparatus, due to a recent demand for image recording on normal sheets of paper. According to this image forming principle, after a photosensitive drum as a latent image carrier is precharged, the photosensitive drum is exposed to a light image to have an electrostatic latent image formed thereon.

This electrostatic latent image is developed by a developing unit so that a toner image is formed on the photosensitive drum. This toner image is then transferred onto a sheet of paper.

To charge the photosensitive drum, a charger whose function is based on corona discharge, such as a corotron, has been used. The corona discharge produces ozone, which is harmful to human bodies, and deteriorates the photosensitive drum. In this respect, there is a demand for a charger which does not use corona discharge, and a brush charger has been proposed as such charging means. The brush charger causes a voltage-applied conductive brush to contact a photosensitive body to thereby charge the photosensitive body.

A rotary type brush charger will be described below. As shown in FIG. 1A, a rotary brush charger 41 has a rotary brush having a conductive brush 411 provided around a rotary shaft 410. This rotary shaft 410 is applied with a voltage by a voltage source 412. A photosensitive drum 40 has a photosensitive layer 400 provided on a conductive base 401. The conductive brush 411 is arranged to face the photosensitive layer 400 in such a way that its tip comes in contact with the photosensitive layer 400. As shown in FIG. 1B, the photosensitive layer 400 of the photosensitive drum 40 is charged with the voltage applied to the rotary shaft 410 of the brush charger 41. Clogging of a foreign matter such as a residue toner between the photosensitive drum 40 and the conductive brush 411 can be prevented by rotating the rotary shaft 410 of this rotary brush charger 41 in the same direction as the rotational direction of the photosensitive drum 40 as indicated by the arrow.

As this brush charger 41 charges the photosensitive drum 40 without using corona discharge, no harmful ozone will be produced, thus contributing to accomplishing an excellent image forming apparatus from the viewpoint of environmental protection.

As mentioned above, the brush charger is based on the principle that the conductive brush 411 contacts the photosensitive drum 40 to charge the drum 40. To surely provide the proper contact, the conductive brush 411 should contact the photosensitive drum 40 with a certain degree of pressure. This pressure is likely to bend the bristles of the conductive brush 411 at both open ends as shown in FIG. 2. In other words, at both ends of the conductive brush 411, the conductive fibers of this brush 411 are pushed in the axial direction of the photosensitive drum 40 and directly contact the conductive base 401 of the photosensitive drum 40 at both ends thereof, or non-photosensitive regions 402 of the photosensitive drum 40 at both ends thereof where there is no photosensitive layer 400 formed. When this occurs, a current concentrates on those pushed conductive fibers of the conductive brush 411, causing a current leak. This leak causes the charged potentials at both widthwise ends of the photosensitive layer 400 of the photosensitive drum 40 to become unstable. The potential levels of those regions of the photosensitive drum 40 therefore become lower so that a toner will stick there, staining the print background portion. Further, the pushed bristles of the conductive brush 411 may be damaged by the concentrated current.

To overcome the above shortcoming, the photosensitive layer 400 of the photosensitive drum 40 may be formed wider to prevent the conductive fibers of the conductive brush 411 from contacting the conductive base 401. As the widened portion is hardly charged, however, a toner stick there, staining both ends of a sheet on which a latent image is transferred.

SUMMARY OF THE INVENTION

It is therefore a primary object of the present invention to provide a brush charger designed to prevent the bristles of the conductive brush at both ends from being bent to thereby ensure stable charging, and an image forming apparatus using this brush charger.

It is another object of the present invention to provide a brush charger designed to inhibit the bristles of the conductive brush at both ends from being bent to thereby prevent the conductive brush from being damaged, and an image forming apparatus using this brush charger.

It is a further object of the present invention to provide a brush charger designed to inhibit the bristles of the conductive brush at both ends from being bent to thereby prevent a latent image carrier from having an improperly charged region, and an image forming apparatus using this brush charger.

It is a still further object of the present invention to provide a brush charger with a simple structure to prevent the bristles of the conductive brush at both ends from being bent, and an image forming apparatus using this brush charger.

To achieve the foregoing and other objects and in accordance with the purpose of the present invention, according to one aspect of the present invention, there is provided a brush charger for charging a latent image carrier, which comprises a conductive rotary shaft applied with a charging voltage; a conductive brush provided around the conductive rotary shaft insuch a way that a tip of the conductive brush contacts the latent image carrier; elastic insulating members provided at both ends of the conductive rotary shaft, for restricting end portions of the conductive brush from spreading along the conductive rotary shaft; and stationary members respectively provided at one ends of the elastic insulating members, for compressing the elastic insulating members toward the conductive brush.

According to another aspect of the present invention, there is provided an image forming apparatus comprising an endless latent image carrier; a brush charger for charging the endless latent image carrier, which includes a conductive rotary shaft applied with a charging voltage, a conductive brush provided around the conductive rotary shaft in such a way that a tip of the conductive brush contacts the endless latent image carrier, and elastic insulating members provided at both ends of the conductive rotary shaft, for restricting end portions of the conductive brush from spreading along the conductive rotary shaft; a voltage source for applying the charging voltage to the conductive rotary shaft; means for forming an electrostatic latent image on the charged endless latent image carrier; developing means for developing the electrostatic latent image on the endless latent image carrier; and stationary members respectively provided at one ends of the elastic insulating members, for compressing the elastic insulating members toward the conductive brush.

According to the present invention, the restricting members provided at both ends of the conductive brush can restrict the bending of the bristles of the conductive brush at both ends to thereby prevent the conductive brush at both ends from spreading outward. It is therefore possible to prevent the short-circuiting from occurring due to the spreading of the bristles of the conductive brush at both ends and to prevent the both end portions of the conductive brush from being damaged. As the restricting members are insulative, they will not cause short-circuiting even when contacting the latent image carrier. Further, as the restricting members are made of an elastic member and stationary members for compressing the restricting members toward the conductive brush, proper pressure can be applied to the end portions of the conductive brush by the restricting members so that the end portions of the conductive brush can be restricted without applying excess pressure to the conductive brush. It is also possible to prevent the pressure from becoming a large load to the rotation of the conductive brush.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENT

Figure 1A:
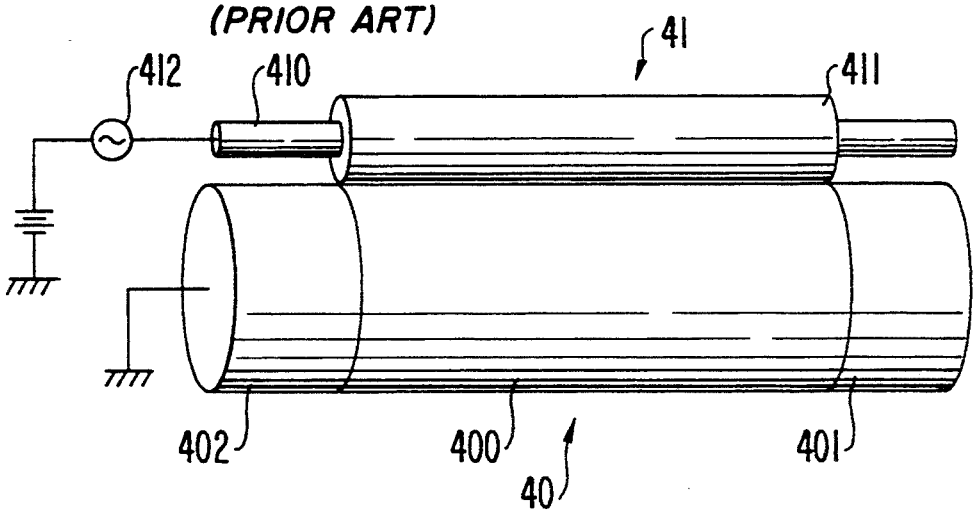
FIG. 1A (PRIOR ART)
FIGS. 1A and 1B are diagrams illustrating prior art.
Figure 1B:
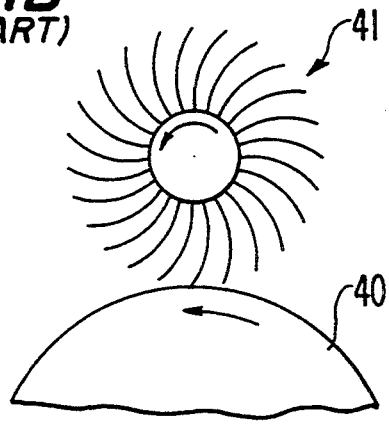
FIG. 1B (PRIOR ART)
Figure 2:
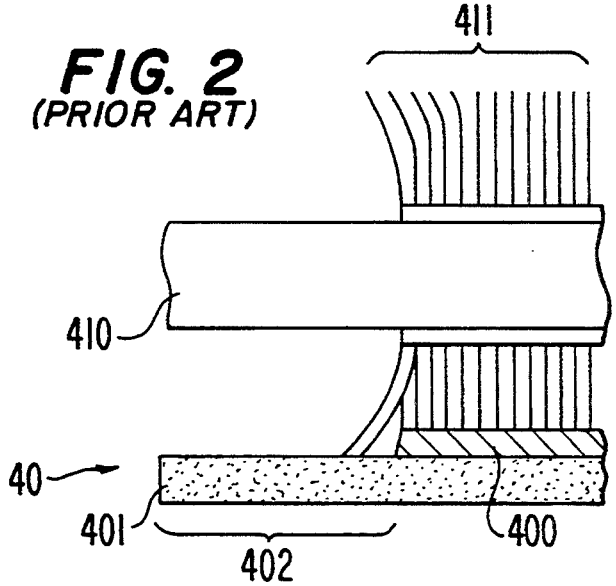
FIG. 2 (PRIOR ART)
FIG. 2 is a diagram for explaining the problems of the prior art.
Figure 3:
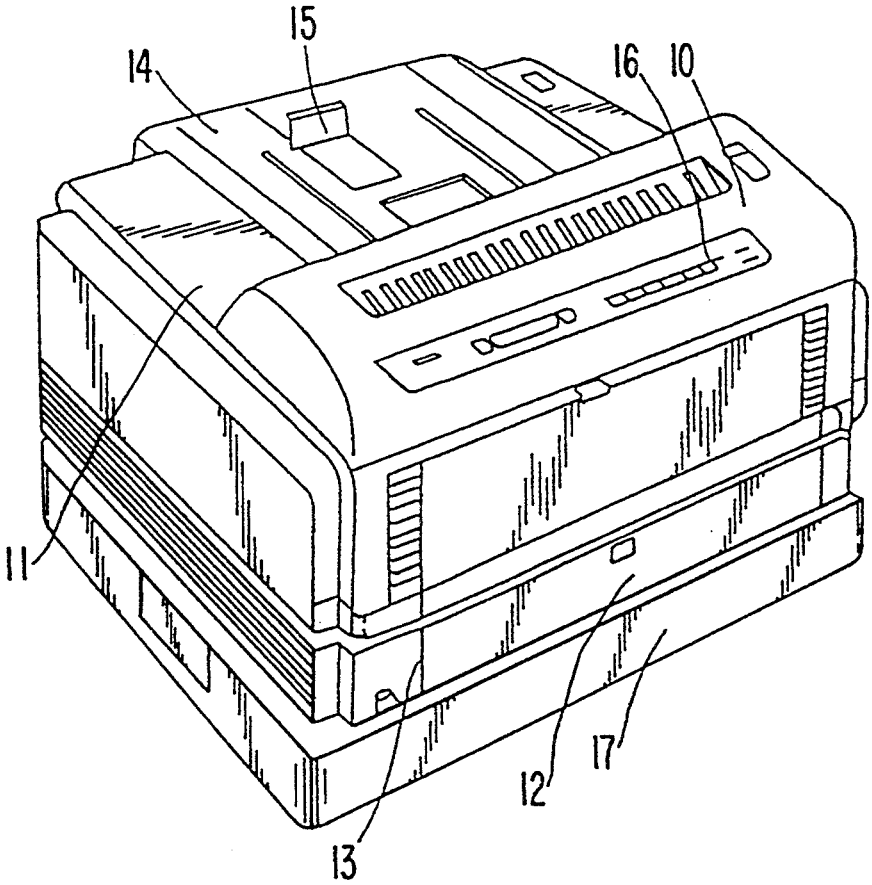
FIG. 3 is a perspective view showing the outline of an image forming apparatus according to one embodiment of the present invention.
Figure 4:
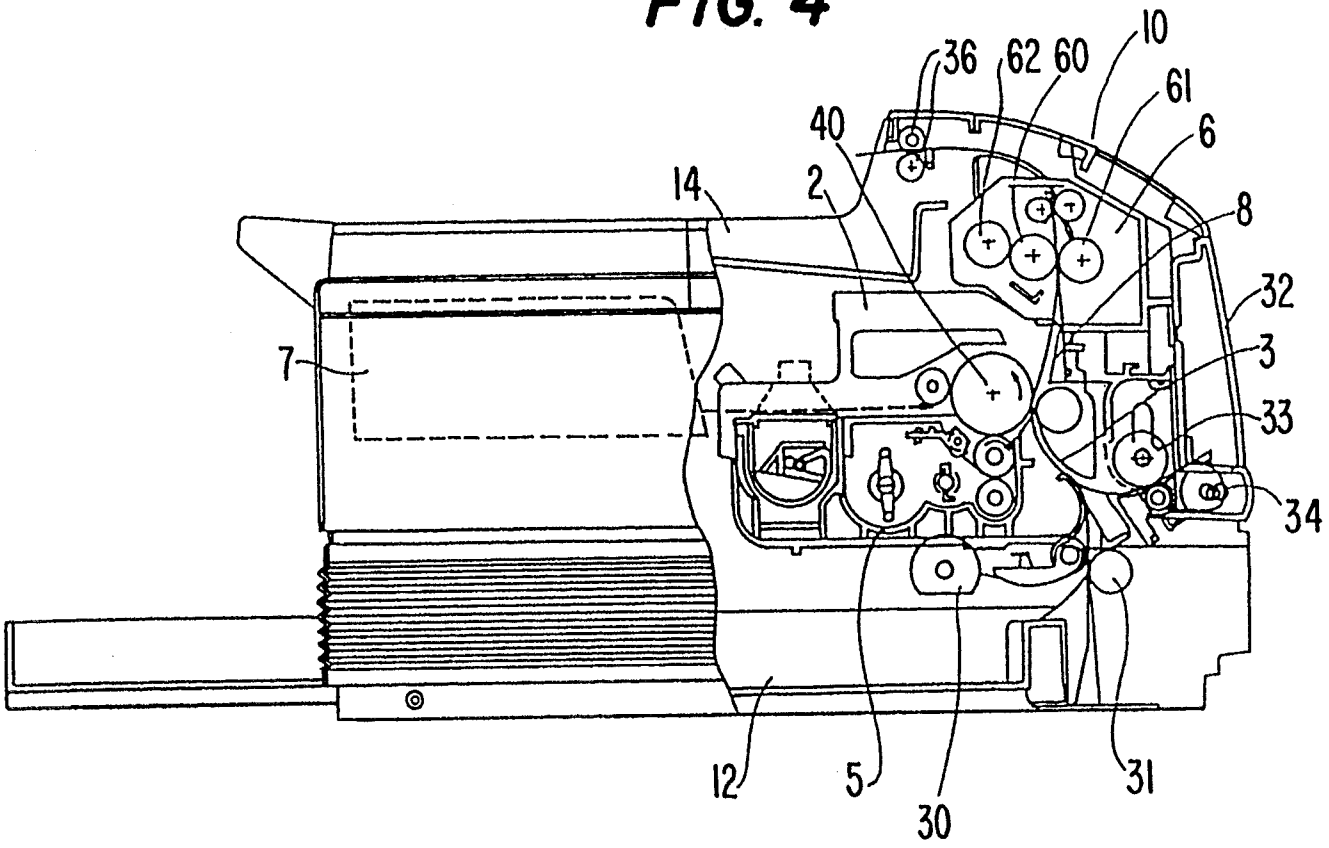
FIG. 4 is a cross-sectional view showing the interior of the image forming apparatus shown in FIG. 3.
Figure 5:
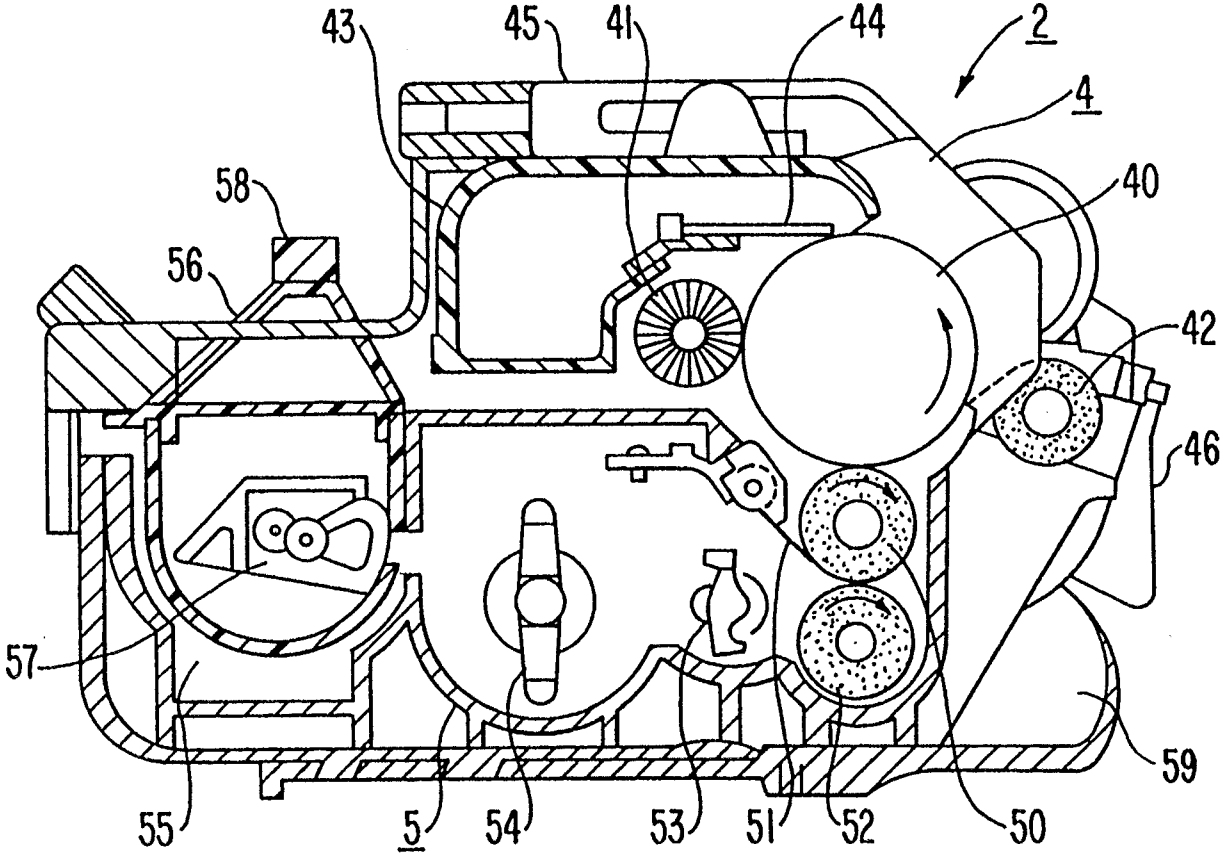
FIG. 5 is a cross section of a process unit of the image forming apparatus shown in FIG. 4.
Figure 6:
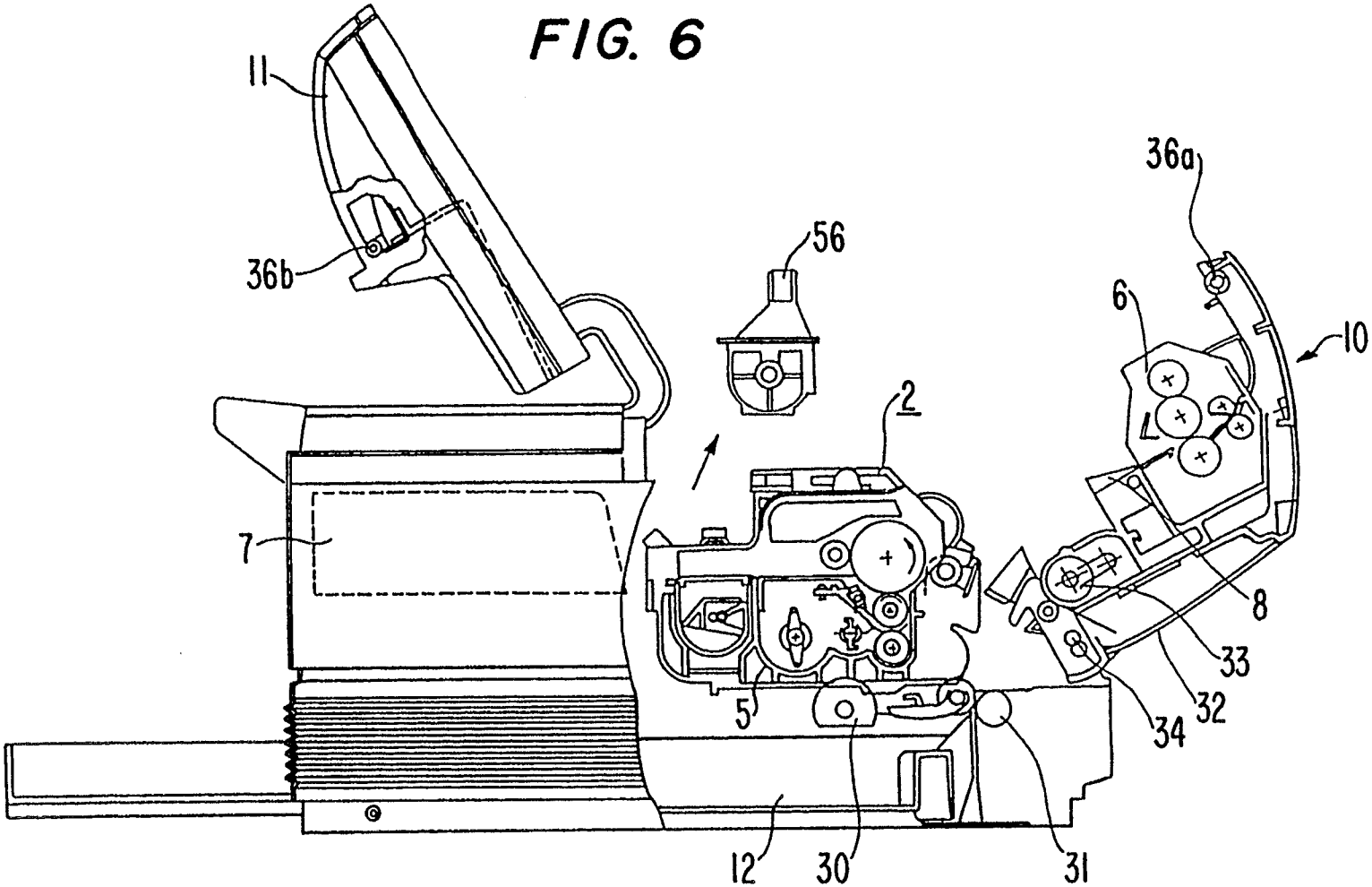
FIG. 6 is a diagram for explaining the state of the image forming apparatus in FIG. 4 when its covers are open.
Figure 7A:
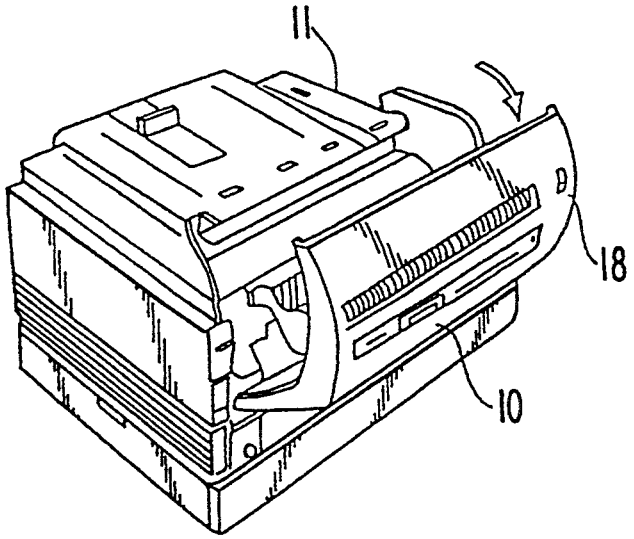
FIGS. 7A and 7B are diagrams illustrating the image forming apparatus in FIG. 3 with its covers open.
Figure 7B:
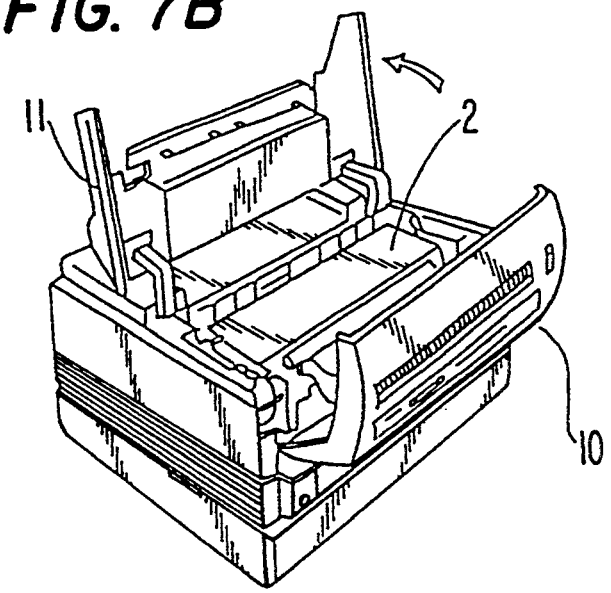
Figure 8:
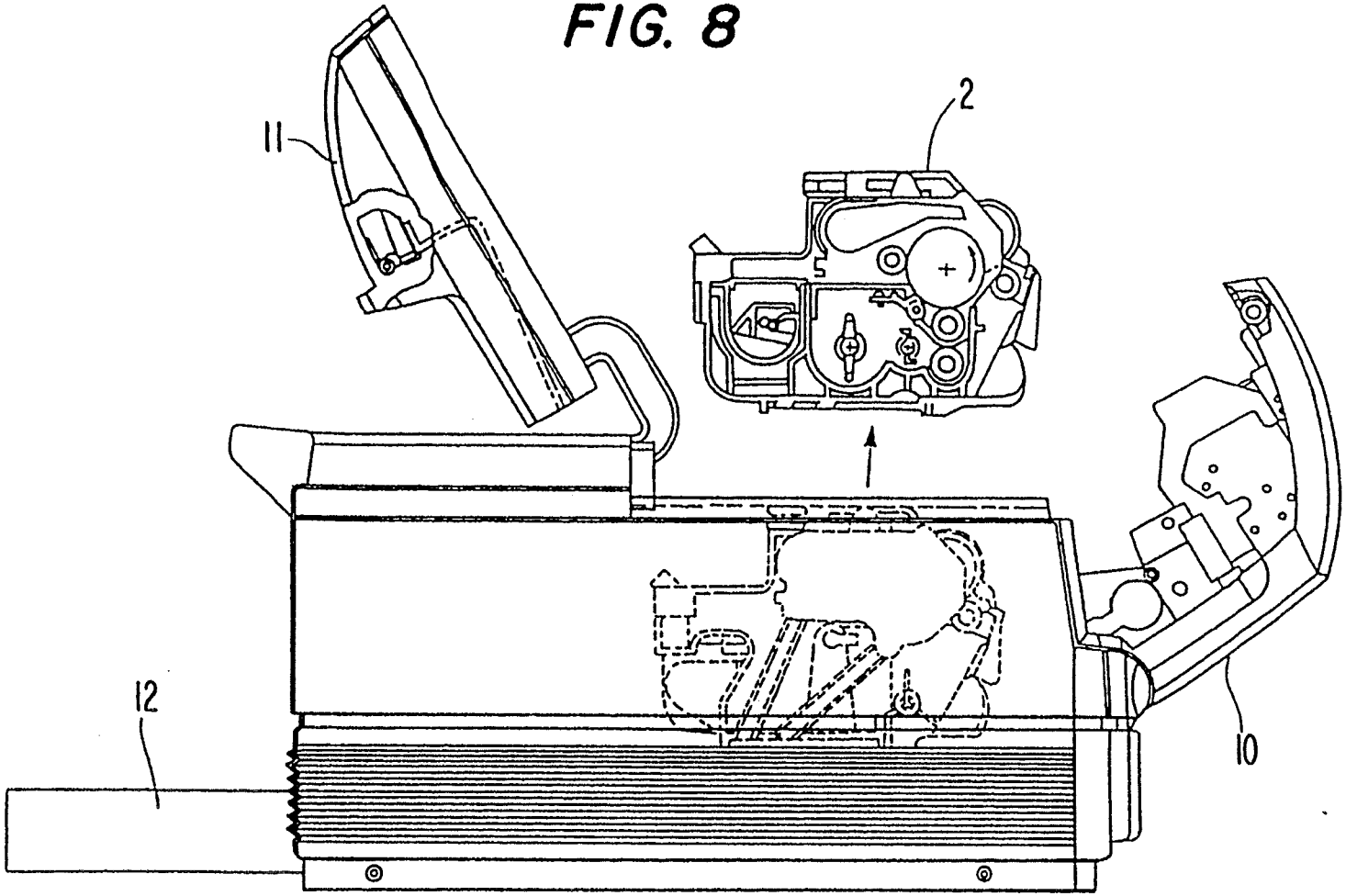
FIG. 8 is a diagram for explaining how to exchange the process unit of the image forming apparatus shown in FIG. 4.

FIG. 3 is a perspective view showing the outline of an image forming apparatus according to one embodiment of the present invention, FIG. 4 is a cross-sectional view showing the interior of the image forming apparatus shown in FIG. 3, FIG. 5 presents a cross section of a process unit of the image forming apparatus shown in FIG. 4, FIG. 6 illustrates the image forming apparatus in FIG. 4 with its covers open, FIG. 7A is a perspective view of the image forming apparatus with its front cover open, FIG. 7B is a perspective view of the image forming apparatus with its upper cover open, and FIG. 8 illustrates the image forming apparatus with both the front and upper covers open.

The illustrated image forming apparatus is an electrophotographic printer; FIG. 3 is a perspective view of the apparatus as viewed from the front. In FIG. 3, a front cover 10 is opened frontward of the apparatus to open a feeding path 3 shown in FIG. 4. An upper cover 11 covers the top of the apparatus, and is opened upward of the apparatus. When opened, the upper cover 11 opens the top of the apparatus. A sheet cassette 12 is to be set in the apparatus from the front thereof through a cassette inserting port 13. A stacker 14 is provided at the top of the apparatus to receive printed sheets. A sheet guide 15 is provided on the stacker 14 to guide the sheet discharged on the stacker. An operation panel 16 is provided at a front cover 10 and has various switches and a display section. A controller box 17 is provided at the bottom of the apparatus and accommodates printer control circuits, etc.

Referring to the cross-sectional view in FIG. 4, an electrophotographic process unit 2 is provided above the sheet cassette 12 and will be described later with reference to FIG. 6. A thermal fixing unit 6 causes a sheet to be put through between a heat roller 60 and a backup roller 61 to fix a toner image on that sheet. This thermal fixing unit 6 is provided with a cleaning roller 62 for removing a toner from the heat roller 60. An optical unit 7 uses a polygon mirror to scan the photosensitive drum 40 with a beam from a semiconductor laser, which is driven according to image information, thereby writing an image on the photosensitive drum 40. The light image from the optical unit 7 passes above a developing unit 5 (which will be described referring to FIG. 5) of the process unit 2 as indicated by a broken-lined arrow to irradiate the photosensitive drum 40 of the process unit 2. A sheet separator 8 has a discharge electrode to apply charges of the opposite polarity to that of the potential at the back of the sheet on which the toner image on the photosensitive drum 40 has been transferred, to that back of the sheet to deelectrify the back of the sheet, thereby separating the sheet from the photosensitive drum 40.

A pickup roller 30 serves to pick up sheets in the sheet cassette 12. A resist roller 31 aligns the leading edge of the sheet picked up by the pickup roller 30, and feeds out the sheet. Reference numeral "32" denotes a manual-inserting guide 32 which guides a manually inserted sheet to a feeding roller 33 when opened rightward in FIG. 4. The feeding roller 33 feeds the sheet, guided by the manual-inserting guide 32, toward the photosensitive drum 40 of the process unit 2. Reference numeral "34" is the rotary shaft of the front cover 10. Discharge rollers 36 are provided at the top portion of the front cover 10 to discharge the sheet, passing through the thermal fixing unit 6, onto the stacker 14.

As shown in the cross-section view in FIG. 5, the process unit 2 comprises a drum cartridge 4 and the developing unit 5. The developing unit 5 is attached to the drum cartridge 4 by pins (not shown), and can be separated therefrom by detaching the pins.

The structure of the drum cartridge 4 will now be described. In FIG. 5, the photosensitive drum 40 has an organic photosensitive layer (OPC or the like) 400 formed on the surface of a cylindrical base 401 of aluminum or the like, and is rotatable counterclockwise as shown. A brush charger 41 is constituted by winding a conductive brush, which has conductive rayon fibers woven into the core, around the rotary shaft, as will be described later in conjunction with FIGS. 9 and 10. The photosensitive drum 40 is uniformly charged to about −600 V by this brush charger 41. A transfer roller 42 is provided at the drum cartridge 4, and is made of a conductive porous rubber material, such as porous polyurethane foam (sponge). This transfer roller 42 is applied with a transfer voltage and is pressed against the photosensitive drum 40 to transfer the toner image on the photosensitive drum 40 onto the sheet. A waste toner box 43 is provided with a scraping blade 44, which scrapes the residue toner off the photosensitive drum 40, so that the box 43 receives the scraped toner. A handle 45 is provided to permit a user to carrying the drum cartridge 4 with a hand. A roller cover 46 serves to hold and protect the transfer roller 42.

The structure of the developing unit 5 will be described next. Referring to FIG. 5, a developing roller 50 is a conductive elastic roller, which is preferably made of a conductive porous rubber material, such as conductive porous polyurethane foam (sponge). The developing roller 50 rotates clockwise as shown in the diagram to carry a non-magnetic, one-component toner to the photosensitive drum 40 while holding the toner with the retentive force of its surface. This developing roller 50 is pressed against the photosensitive drum 50 with a predetermined nip width and is applied with a developing bias voltage of about −300 V. A layer-thickness restricting blade 51, which is made of a 0.1-mm thick stainless plate, serves to restrict the thickness of the toner layer on the developing roller 50 to a predetermined thickness. This layer-thickness restricting blade 51 is pressed against the developing roller 50 and is applied with a negative voltage of about −400 V. This applied voltage allows the layer-thickness restricting blade 51 to supply negative charges to the toner to forcibly charge the toner negatively at the time of restricting the thickness of the toner layer. Accordingly, the toner can be charged stably even under the conditions of high humidity and high temperature. A reset roller 52 is disposed to face the developing roller 50 and rotates in the same direction as the developing roller 50. This reset roller 52 is applied with a bias voltage of −400 V to scrape the toner off the developing roller 50 in the right-hand side of the diagram and supply the toner to the developing roller 50 in the left-hand side of the diagram.

Reference numerals "53" and "54" denote paddle rollers, which rotate to stir the non-magnetic, one-component toner in the developing unit 5 and charge the toner. In addition, the paddle rollers 53 and 54 supply the stirred toner toward the reset roller 52. A toner cassette retainer 55 retains a toner cassette 56, which contains the non-magnetic, one-component toner. This toner cassette 56 is detachably set in the toner cassette retainer 55. A toner supply lever 57 is provided in the toner cassette 56, and rotates to supply the toner in the toner cassette 56 into the developing unit 5. The toner cassette 56 is provided with a handle 58 to allow a user to hold the toner cassette 56 with a hand. Sheet guide ribs 59 are provided below the roller cover 46. This sheet guide ribs 59, together with the roller cover 46, form a path for guiding the sheet between the photosensitive drum 40 and the transfer roller 42.

The function of this printer will be described referring to FIGS. 3 through 5. A sheet in the sheet cassette 12 is picked up by the pickup roller 30 and abuts against the resist roller 31. After the leading edge is aligned by the resist roller 31, this sheet is fed toward the photosensitive drum 40 along a U-shaped feeding path 3. Meantime, when the picked sheet reaches the resist roller 31, the optical unit 7 starts exposing the photosensitive drum 40 to image light. As a result, the potential of the image-exposed portion of the photosensitive drum 40, which has been charged to −600 V by the brush charger 41 becomes zero, thus forming an electrostatic latent image corresponding to the image to be copied.

As a bias voltage of −300 V is applied to the developing roller 50 in the developing unit 5, the negatively charged toner sticks on the image-exposed portion of zero potential of the photosensitive drum 40, forming a toner image thereon. The toner image on the photosensitive drum 40 is transferred onto the sheet, fed by the resist roller 31, by the transfer roller 42 due to the electrostatic force and pressure. The back of the sheet that is electrostatically adsorbed to the photosensitive drum 40 is deelectrified by the charges supplied by the sheet separator 8, so that this sheet is separated from the photosensitive drum 40. The separated sheet is fed to the thermal fixing unit 6 where the toner image on the sheet is thermally fixed by the heat roller 60. The image-fixed sheet is then discharged on the stacker 14 by the discharge rollers 36.

A sheet manually inserted through the manual-inserting guide 32 pulled open is likewise conveyed toward the photosensitive drum 40 by the feeding roller 33. The toner image on the photosensitive drum 40 is transferred onto that sheet by the transfer roller 42 due to the electrostatic force and pressure. The back of the sheet that is electrostatically adsorbed to the photosensitive drum 40 is deelectrified by the charges supplied by the sheet separator 8, so that this sheet is separated from the photosensitive drum 40. The separated sheet is then fed to the thermal fixing unit 6 where the toner image on the sheet is thermally fixed by the heat roller 60. The resultant sheet is then discharged on the stacker 14 by the discharge rollers 36.

In FIG. 6 which shows the front cover 10 and upper cover 11 of the apparatus open, the front cover 10 is opened frontward (rightward in the diagram) around the cover rotary shaft 34. Provided on this front cover 10 are the manual-inserting guide 32, the feeding roller 33, the sheet separator 8, the thermal fixing unit 6 and an upper discharge (drive) roller 36*a* of the discharge roller pair 36. The upper cover 11 is opened upward of the apparatus (upward in the diagram) around a shaft (not shown). A lower discharge (pinch) roller 36b of the discharge roller pair 36 is provided on the upper cover 11.

When the front cover 10 is opened by unlocking a lock lever 18 of the front cover 10, as shown in FIGS. 6 and 7A, the U-shaped feeding path 3 extending from the resist roller 31 to the discharge rollers 36 is opened, making it easier to remove any jammed sheet. If the transfer roller 42 is shifted from the proper position facing the photosensitive drum 40, i.e., if there is a shift in parallelism and position to the photosensitive drum 40, image transfer cannot be executed properly. In this respect, the transfer roller 42 is provided on the process unit 2. Although this design does not open the space between the photosensitive drum 40 and the transfer roller 42, a jammed sheet can easily be removed without any problem even if that portion does not become free.

The reason why the whole thermal fixing unit 6 is provided on the front cover 10 is that if the thermal fixing unit 6 were divided to open the feeding path, a part of the thermal fixing unit 6 should be provided on the process unit 2, thus inconveniencing a user to remove the process unit 2. Although this design does not open the space between the heat roller 60 of the thermal fixing unit 6 and the backup roller 61, a jammed sheet can easily be removed without any problem even if that portion does not become free.

The front cover 10 is provided above the upper cover 11 at the sheet discharging portion so that the upper cover 11 does not become free unless the front cover 10 is opened as shown in FIG. 6. When the front cover 10 is opened and the upper cover 11 is opened next as shown in FIG. 7B, therefore, the top portion of the apparatus and part of the front portion of the apparatus are opened as shown in FIG. 6. Accordingly, the toner cassette 56 can easily be removed or attached from the front side of the apparatus while keeping the process unit 2 installed in the apparatus, thus allowing for the exchange of the toner cassette 56 alone.

As the front side of the apparatus is opened by opening the front cover 10 and the top portion of the apparatus is opened by opening the upper cover 11 as shown in FIG. 8, the attachment and detachment of the process unit 2 can also be performed easily. Even if the process unit 2 is large, therefore, the exchange of the process unit 2 is easy. In other words, the process unit 2 can be designed large, particularly, the developing unit 5 in the process unit 2 can be designed large, so that the quantity of the retainable developer can be increased, thus making the exchanging cycle of the developing unit 5 significantly long.

Further, since the developer can be supplemented through the exchange of the toner cassette 56 alone, the exchanging cycle of the developing unit 5 can be made longer. Furthermore, as the covers 10 and 11 are opened with the discharge rollers 36 separated into upper and lower rollers, the entire U-shaped feeding path 3 can be opened, thus facilitating removal of a jammed sheet.

Figure 9:
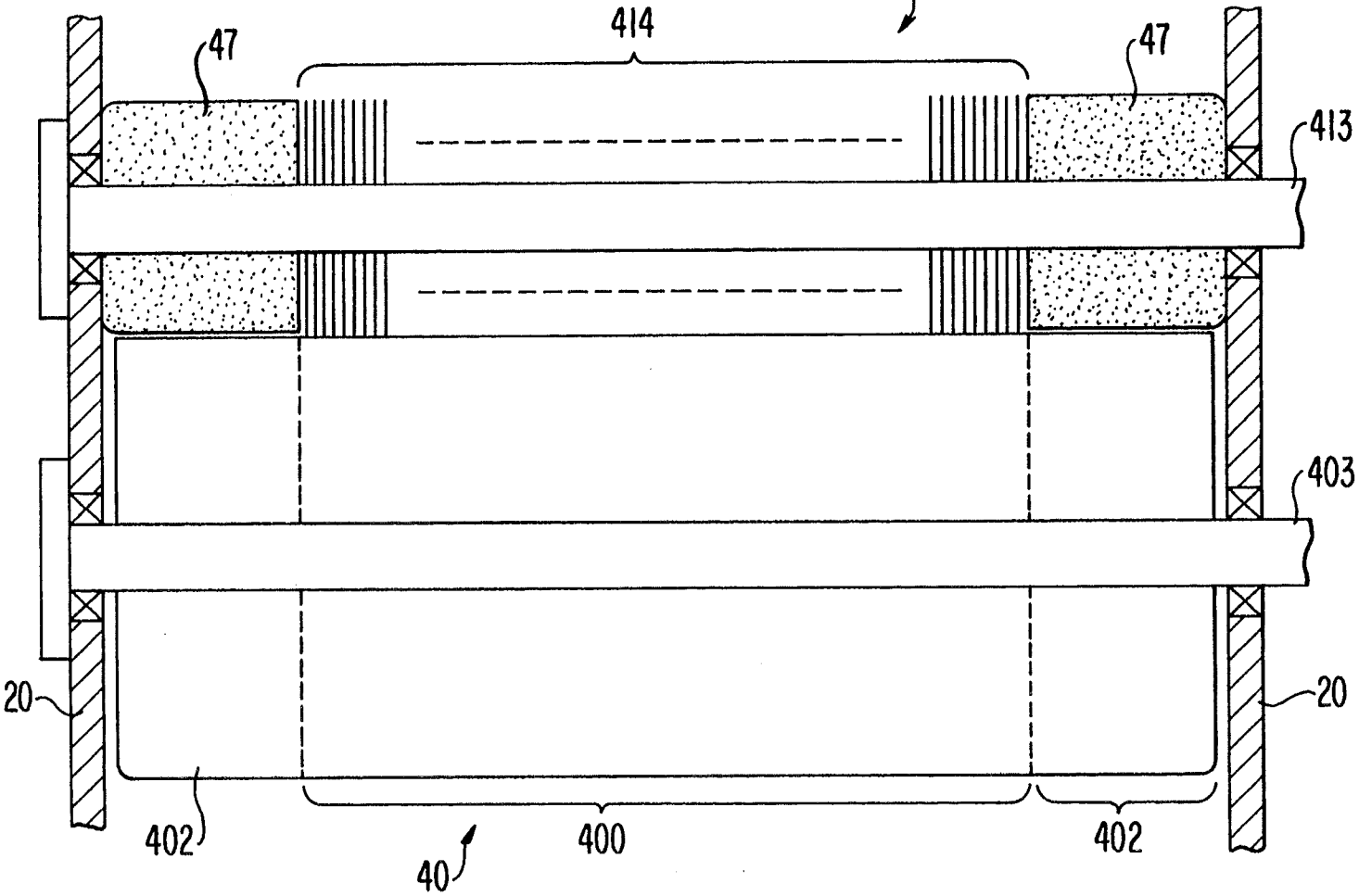
FIG. 9 is a diagram showing the cross section of a brush charger of the image forming apparatus in FIG. 4.
Figure 10:
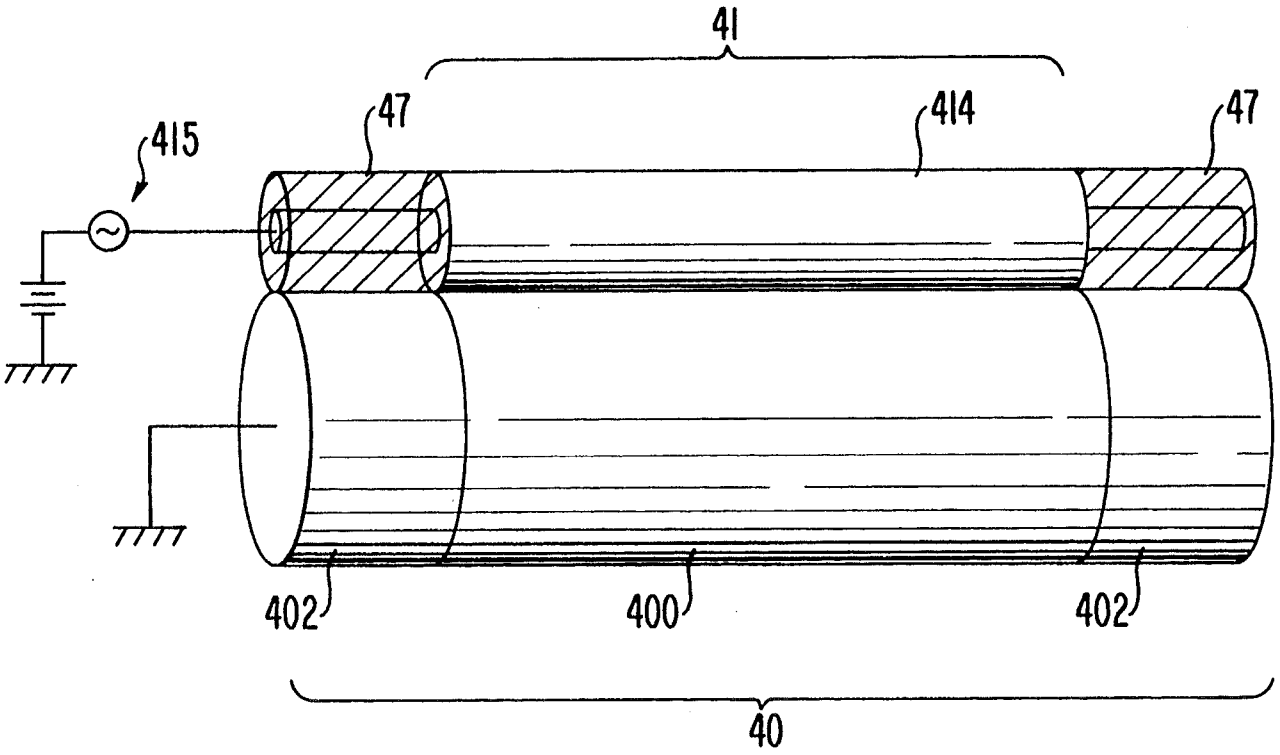
FIG. 10 is a perspective view of the brush charger in FIG. 9.
Figure 11:
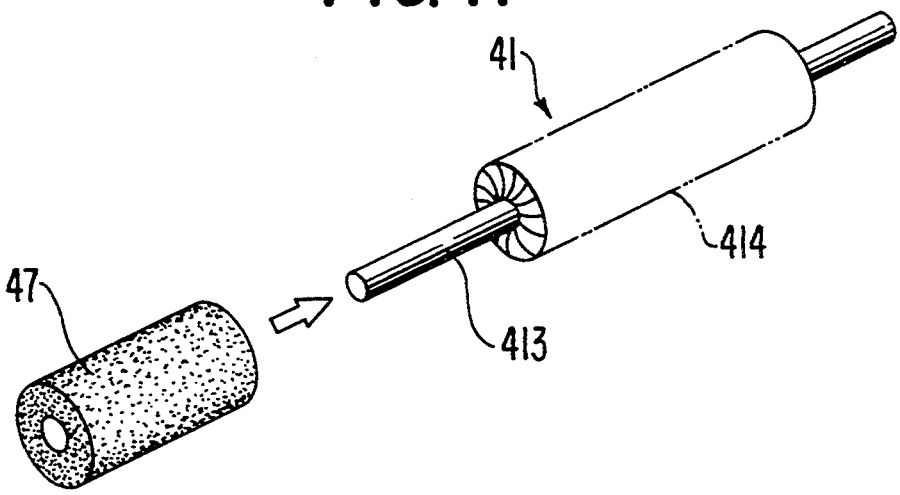
FIG. 11 is a diagram showing the structure of an insulating member of the brush charger in FIG. 9.
Figure 12:
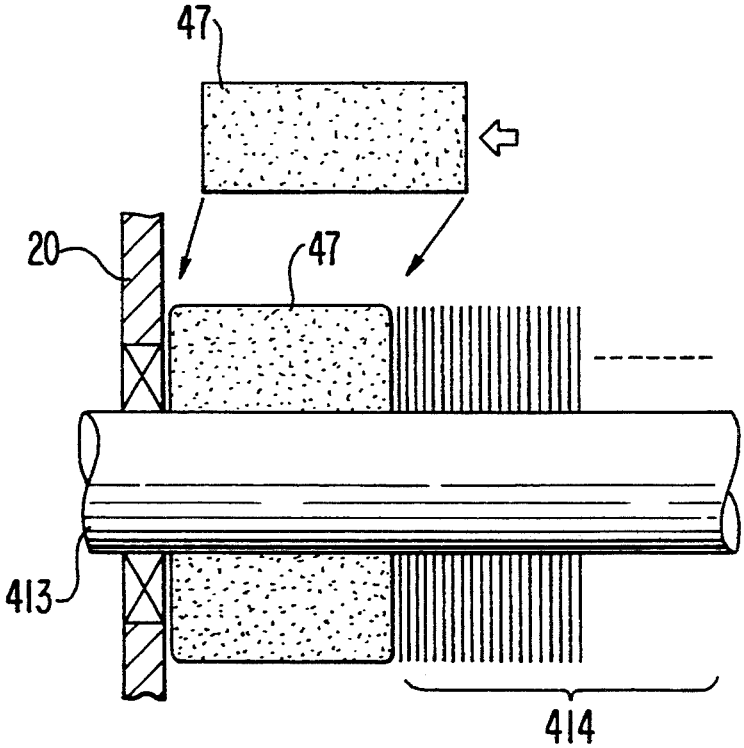
FIG. 12 is a diagram illustrating how the insulating member of the brush charger in FIG. 9 is attached.

FIG. 9 is a cross-sectional view of the brush charger of the image forming apparatus in FIG. 4, FIG. 10 is an explanatory diagram of the brush charger in FIG. 9, FIG. 11 is an explanatory diagram of a restricting member, and FIG. 12 illustrates how the restricting member is attached.

Referring to FIGS. 9 and 10, the brush charger 41 has a conductive brush 414 provided around a conductive rotary shaft 413. A brush having conductive rayon fibers (REC B" a product of UNITIKA Ltd.) woven into the core is used as the conductive brush 414. The length of the woven conductive fibers is about 4 mm. The conductive rayon fibers have a resistance of $10^{12}\ \Omega\cdot$cm. This rotary brush charger 41 has an outside diameter of about 16 mm and a rotational speed of 56 mm/s, about 0.8 times the peripheral speed of the photosensitive drum 40, 70 mm/s. The rotary shaft 413 is applied with a voltage by a voltage source 415; this voltage is a DC offset voltage of −650 V superimposed on an AC voltage of a frequency of 500 Hz and a peak-to-peak voltage of 1.2 KV. Accordingly, the photosensitive drum 40 is uniformly charged to about −600 V by the brush charger 41.

Restricting members 47 are fitted on the rotary shaft 413 of the brush charger 41 at both ends as shown in FIG. 9. The restricting members 47 are constituted of an elastic insulating member having a roller shape. The elastic insulating member may be urethane foam, sponge, rubber or the like. The restricting members 47 are fitted on the rotary shaft 413 from both ends thereof, as shown in FIG. 11.

As shown in FIG. 9, the photosensitive drum 40 has the aforementioned photosensitive layer 400 with a width corresponding to the maximum width of sheets at the center and non-photosensitive layer regions 402 at both ends where the aluminum base 401 is exposed. The photosensitive drum 40 has its rotary shaft 403 rotatably supported on a frame 20 of the process unit 2. The conductive brush 414 of the brush charger 41 has the same width as the photosensitive layer 400 of the photosensitive drum 40 and is disposed to face the photosensitive layer 400. The rotary shaft 413 of the brush charger 41 is likewise rotatably supported on the frame 20. The restricting members 47 are provided between the frame 20 and the conductive brush 414.

Each restricting member 47 is an elastic member inserted, while compressed, between the frame 20 and the conductive brush 414, as shown in FIG. 12. The restoring force of the elastic restricting members 47 can apply pressure to both sides of the conductive brush 414. This pressure can prevent the conductive brush 414 from being bent and spreading outward at both ends due to the pressured contact of the conductive brush 414 with the photosensitive drum 40.

The desirable compressibility of the elastic restricting members 47 is 10% or above. With the compressibility of less than 10%, the restoring force of the restricting members 47 yields to the repulsive force of the conductive brush 414, thus allowing the bristles of the brush 414 at both ends to bent. In this case, the conductive brush 414 is likely to contact the non-photosensitive layer regions 402, staining the background.

In a preferable example, the restricting members 47 should be rotatable with respect to the conductive rotary shaft 413 if the restricting members 47 contact the photosensitive drum 40. Since this design permits the restricting members 47 to rotate with the rotation of the photosensitive drum 40, clogging of a foreign matter such as a residue toner between the photosensitive drum 40 and the conductive brush 411 can be prevented and the restricting members 47 will not become a rotational load to the photosensitive drum 40. Further, the above consideration is unnecessary if the restricting members 47 do not contact the photosensitive drum 40.

In short, as the restricting members 47 are provided at both ends of the conductive brush 414 of the brush charger 41, bending and outward spreading of the bristles of the conductive brush 414 at both ends can mechanically be prevented and the occurrence of a leak due to such bending of the brush 414 can be prevented by a simple structure. As the restricting members 47 are made of an elastic material and are set in a compressed form, both sides of the conductive brush 414 can be pushed with the proper pressure, thus ensuring a simple way of setting pressure. Further, since the frame 20 is used to press one end of each restricting member 47, no particular support means is necessary for the restricting members 47 so that the pressure applying means can be accomplished simply by inserting those members 47 between the frame 20 and the conductive brush 414.

The present invention is not limited to the above embodiment, but may be modified in various manners as follows. First, although the process unit 2 has been explained as an electrophotographic mechanism that performs charging, exposing and developing operations in the above-described embodiment, this invention can be adapted for other recording systems which execute a charging operation. Secondly, although the process unit 2 is exchangeable by a user, this invention is applicable to an image forming apparatus which does not allow the user to exchange the process unit. Thirdly, while the restricting members 47 are made of an elastic material and are placed in a compressed form, a modification may be made so that insulating members are fixed on the rotary shaft 413 at both ends of the conductive brush 414. Fourthly, although the brush charger 41 has been explained as a rotary type, it may be of a stationary type. Fifthly, the type of sheets are not limited to paper, and other media may be used as well. Sixthly, although the image forming apparatus has been explained as a printer, it may be a different type of image forming apparatus, such as a copying machine or facsimile. Seventhly, although the developing unit uses a non-magnetic, one-component developer in the foregoing description, it may use another known type of developer, such as a magnetic, one-component developer or a magnetic, two-component developer.

What is claimed is:

1. A brush charger for charging a latent image carrier, comprising:

a conductive rotary shaft applied with a charging voltage;

a conductive brush provided around the conductive rotary shaft in such a way that a tip of the conductive brush contacts the latent image carrier;

elastic insulating members provided at both ends of the conductive rotary shaft, for restricting end portions of the conductive brush from spreading along the conductive rotary shaft; and stationary members respectively provided at one ends of the elastic insulating members, for compressing the elastic insulating members toward the conductive brush.

2. The brush charger according to claim 1, wherein the stationary members are a frame for holding the conductive rotary shaft.

3. The brush charger according to claim 2, wherein the insulating members have a substantially cylindrical shape to be fitted on the conductive rotary shaft.

4. The brush charger according to claim 3, wherein the insulating members restrict the conductive brush in such a way that a range of the conductive brush along the conductive rotary shaft is within a range of a latent image carrying layer provided on a conductive base of the latent image carrier along the conductive rotary shaft.

5. The brush charger according to claim 2, wherein the insulating members restrict the conductive brush in such a way that a range of the conductive brush along the conductive rotary shaft is within a range of a latent image carrying layer provided on a conductive base of the latent image carrier along the conductive rotary shaft.

6. The brush charger according to claim 1, wherein the insulating members have a substantially cylindrical shape to be fitted on the conductive rotary shaft.

7. The brush charger according to claim 6, wherein the insulating members restrict the conductive brush in such a way that a range of the conductive brush along the conductive rotary shaft is within a range of a latent image carrying layer provided on a conductive base of the latent image carrier along the conductive rotary shaft.

8. The brush charger according to claim 1, wherein the insulating members restrict the conductive brush in such a way that a range of the conductive brush along the conductive rotary shaft is within a range of a latent image carrying layer provided on a conductive base of the latent image carrier along the conductive rotary shaft.

9. The brush charger according to claim 1, wherein the insulating members are provided on the conductive rotary shaft in non-contact with the latent image carrier.

10. The brush charger according to claim 1, wherein the insulating members are rotatably provided on the conductive rotary shaft.

11. A brush charger for charging a latent image carrier, comprising:

a conductive base applied with a charging voltage;

a conductive brush provided on the conductive base in such a way that a tip of the conductive brush contacts the latent image carrier;

a conductive rotary shaft;

insulating members provided at both ends of the conductive rotary shaft, for restricting end portions of the conductive brush from spreading outward; and means for applying a voltage to the conductive brush, said means including a DC power supply and an AC power supply.

12. The brush charger according to claim 11, wherein the insulating members are made of an elastic material; and stationary members are respectively provided at one ends of the elastic insulating members, for compressing the elastic insulating members toward the conductive brush.

13. The brush charger according to claim 12, wherein the stationary members are a frame for holding the conductive rotary shaft.

14. The brush charger according to claim 11, wherein the insulating members restrict the conductive brush in such a way that a widthwise range of the conductive brush is within a range of a photosensitive layer provided on a conductive base of the latent image carrier.

15. An image forming apparatus comprising:

an endless latent image carrier;

a brush charger for charging the endless latent image carrier having a conductive rotary shaft applied with a charging voltage, a conductive brush provided around the conductive rotary shaft in such a way that a tip of the conductive brush contacts the endless latent image carrier, and elastic insulating members provided at both ends of the conductive rotary shaft, for restricting end portions of the conductive brush from spreading along the conductive rotary shaft;

a voltage source for applying a charging voltage to the conductive rotary shaft;

means for forming an electrostatic latent image on the charged endless latent image carrier;

developing means for developing the electrostatic latent image on the endless latent image carrier; and stationary members respectively provided at one ends of the elastic insulating members, for compressing the elastic insulating members toward the conductive brush.

16. The image forming apparatus according to claim 15, wherein the stationary members are a frame for holding the conductive rotary shaft of the brush charger.

17. The image forming apparatus according to claim 16, wherein the insulating members of the brush charger have a substantially cylindrical shape to be fitted on the conductive rotary shaft.

18. The image forming apparatus according to claim 17, wherein the latent image carrier has a latent image carrying layer formed on a conductive base; and the insulating members of the brush charger restrict the conductive brush in such a way that a range of the conductive brush along the conductive rotary shaft is within a range of the latent image carrying layer of the latent image carrier along the conductive rotary shaft.

19. The image forming apparatus according to claim 16, wherein the latent image carrier has a latent image carrying layer formed on a conductive base; and the insulating members of the brush charger restrict the conductive brush in such a way that a range of the conductive brush along the conductive rotary shaft is within a range of the latent image carrying layer of the latent image carrier along the conductive rotary shaft.

20. The image forming apparatus according to claim 15, wherein the insulating members of the brush charger have a substantially cylindrical shape to be fitted on the conductive rotary shaft.

21. The image forming apparatus according to claim 20, wherein the latent image carrier has a latent image carrying layer formed on a conductive base; and the insulating members of the brush charger restrict the conductive brush in such a way that a range of the conductive brush along the conductive rotary shaft is within a range of the latent image carrying layer of the latent image carrier along the conductive rotary shaft.

22. The image forming apparatus according to claim 15, wherein the latent image carrier has a latent image carrying layer formed on a conductive base; and the insulating members of the brush charger restrict the conductive brush in such a way that a range of the conductive brush along the conductive rotary shaft is within a range of the latent image carrying layer of the latent image carrier along the conductive rotary shaft.

23. The image forming apparatus according to claim 15, wherein the insulating members are provided on the conductive rotary shaft of the brush charger in non-contact with the latent image carrier.

24. The image forming apparatus according to claim 15, wherein the insulating members are rotatably provided on the conductive rotary shaft of the brush charger.

25. An image forming apparatus comprising:

an endless latent image carrier;

a brush charger for charging the endless latent image carrier having a conductive base, a conductive brush provided around the conductive base in such a way that a tip of the conductive brush contacts the endless latent image carrier, and insulating members provided at both ends of the conductive brush, for restricting end portions of the conductive brush from spreading outward;

a voltage source for applying a charging voltage to the conductive base;

means for forming an electrostatic latent image on the charged endless latent image carrier;

developing means for developing the electrostatic latent image on the endless latent image carrier; and means for applying a voltage to the conductive brush, said means including a DC power source and an AC power source.

26. The image forming apparatus according to claim 25, wherein the insulating members of the brush charger are made of an elastic material; and stationary members are respectively provided at one ends of the elastic insulating members, for compressing the elastic insulating members toward the conductive brush.

27. The image forming apparatus according to claim 26, wherein the stationary members are a frame for holding the conductive rotary shaft of the brush charger.

28. The image forming apparatus according to claim 25, wherein the latent image carrier has a photosensitive layer formed on a conductive base; and the insulating members of the brush charger restrict the conductive brush in such a way that a widthwise range of the conductive brush is within a widthwise range of the photosensitive layer of the latent image carrier.

* * * * *